US005462115A

United States Patent [19]

Belden et al.

[11] Patent Number: 5,462,115

[45] Date of Patent: Oct. 31, 1995

[54] GAS AND OIL WELL SWAB

[75] Inventors: Steven V. Belden, Massillon; Dennis D. Belden, Jr., Akron; John G. Corp, Norton, all of Ohio

[73] Assignee: Belden & Blake Corporation, North Canton, Ohio

[21] Appl. No.: 205,069

[22] Filed: Mar. 3, 1994

[51] Int. Cl.[6] ..... E21B 43/25; F04B 47/12

[52] U.S. Cl. ..... 166/177.3; 166/319; 166/333.1; 417/60

[58] Field of Search ..... 166/105.2, 105.3, 166/105.4, 177, 105, 372, 319, 332; 417/53, 59, 60

[56] References Cited

U.S. PATENT DOCUMENTS

| | | | |
|---|---|---|---|
| 2,714,855 | 8/1955 | Brown | 417/60 |
| 2,762,310 | 9/1956 | Eklund | 417/60 |
| 2,850,339 | 9/1958 | Vincent | 417/59 |
| 2,970,547 | 2/1961 | McMurry | 417/60 X |
| 3,249,056 | 5/1966 | Lyles | 417/59 |
| 4,986,727 | 1/1991 | Blanton | 417/60 X |
| 5,253,713 | 10/1993 | Gregg et al. | 417/59 X |

*Primary Examiner*—Frank S. Tsay
*Attorney, Agent, or Firm*—Sand & Sebolt

[57] ABSTRACT

A swab is movably mounted within a well casing and automatically removes fluid from the well upon accumulated pressure at the bottom of the casing reaching a predetermined amount to raise the swab within the casing. The swab has a hollow body with an inner cylindrical bore. A control rod is slidably mounted within the bore and has a cross-sectional configuration whereby only a plurality of sliding contact lines occur between the rod and bore wall to reduce rod hangup and provide increased flow area between the rod and bore wall. A fluid inlet port is formed by an open bottom end of the swab body and is open and closed by a valve member located external of the swab body. The valve member has a generally pointed nose to reduce drag when the swab is descending into the casing, and upon contact of the nose with a stop at the bottom of the well casing, will automatically move to a closed position with the fluid inlet port. A pressure relief valve is mounted in the swab body and automatically opens upon the internal fluid lift pressure in the well casing reaching a predetermined amount to permit the pressure to equalize through the bore to prevent damage to elastomeric seals which surround the swab body.

17 Claims, 3 Drawing Sheets

FIG-8
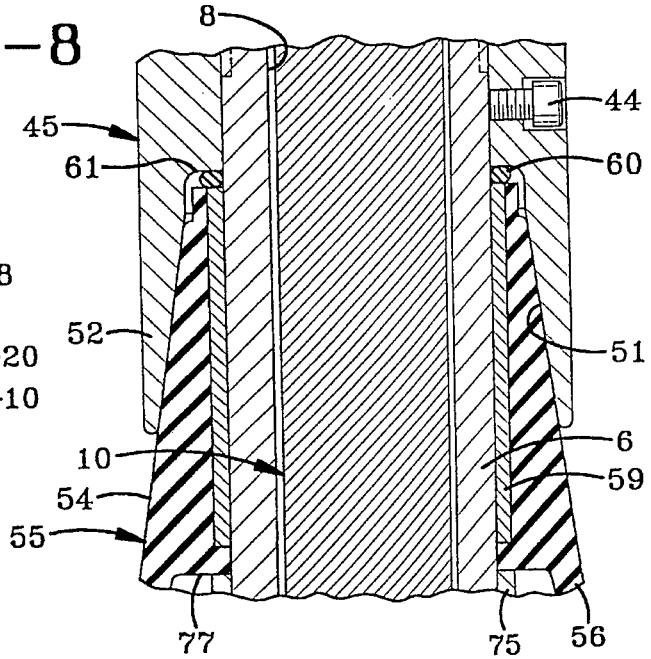
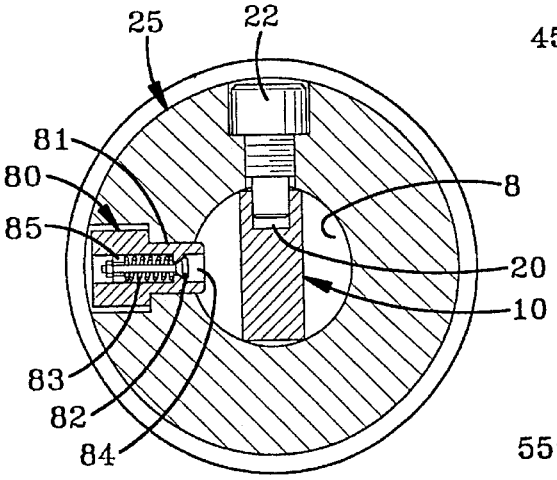
FIG-5
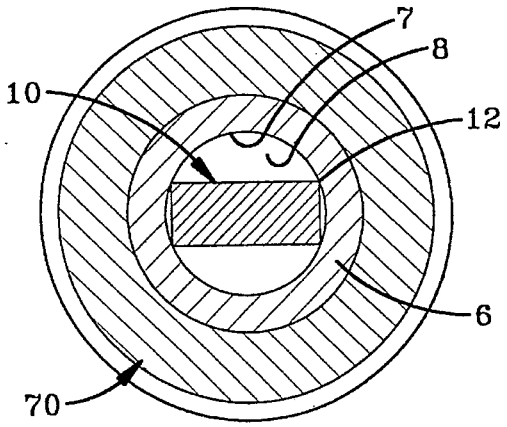
FIG-6
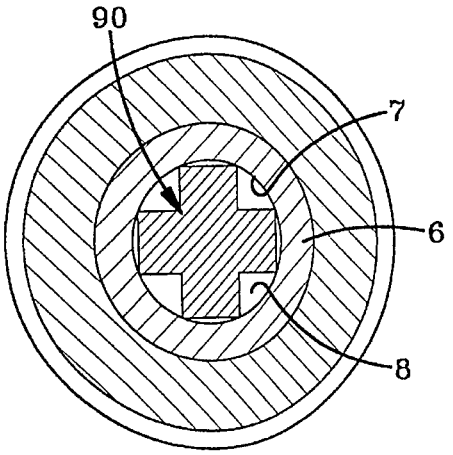
FIG-9
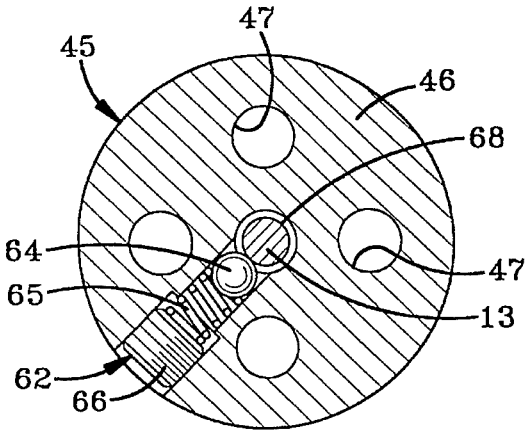
FIG-7
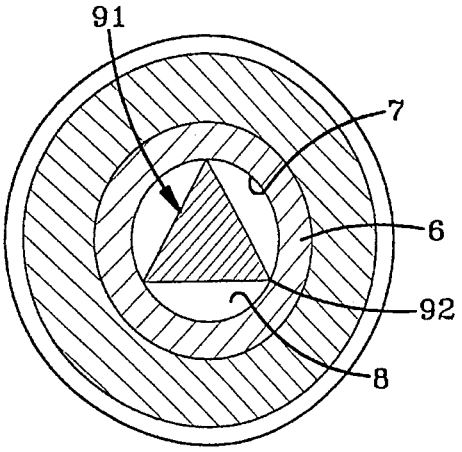
FIG-10

GAS AND OIL WELL SWAB

BACKGROUND OF THE INVENTION

1. Technical Field

The invention relates to gas and oil well swabs used in raising liquids trapped within a well casing. More particularly, the invention relates to such a swab having an external operating valve which opens and closes the fluid flow passage through the swab for its operation and which has a pressure relief valve to prevent damage to the flexible seals.

2. Background Information

Various oil and gas well swabs have been developed which are slidable within a gas well casing or fluid delivery tube for raising the oil from the bottom of the well by using the pressure generated in the bottom of the well casing and/or delivery tube. These devices are commonly referred to as "lifters" or "rabbits" and usually will include a rigid body having external seals mounted thereon, usually formed of a flexible or friction reducing material, to provide a sliding sealing relationship with the internal wall of the casing and/or delivery tube.

These prior art swab devices incorporate a plunger element or control valve and associated rod which is slidably mounted within an internal fluid passage within the swab. A valve mechanism which also is mounted within the body of the swab is actuated to close the internal flow passage when the swab has reached a predetermined depth in the accumulated liquids where the hydrostatic pressure is sufficient to move the valve to its closed position. When the valve is closed, the natural gas existing in the well accumulates below and acts upon the swab as a piston to move the swab and all liquids located above the swab to the well surface. Some examples of these swabs are shown in U.S. Pat. Nos. 4,070,134, 4,813,485 and 4,923,372.

However, problems can occur with such prior art swabs, and in particular with the actuating mechanism therefore, due to the relatively harsh environment in which the swabs are operated, in that the well casings usually will contain sand, dirt and similar debris which can easily effect the operation of the swab and in particular the control rod and valve thereof, especially when the actuating rod lies within a complementary shaped bore within the swab or within retainers, which are subject to hangup due to the accumulation of sand and other particles between the sliding surfaces of the rod and/or bore, interior guide members or the like.

Many of these problems are overcome by the swab of the present invention which use a valve which is located externally at the bottom end of the swab, which valve is closed upon contact with a stop member at the bottom of the well, and does not rely upon the internal fluid pressure within the bottom of the well casing for closing the valve. Furthermore, the hangup problem is eliminated by using a specially shaped actuating rod which provides sliding line contact only with the interior surface of the swab bore, and provides sufficient cross-sectional flow areas around the actuating rod within the well bore for the unrestricted free flow of fluid therethrough. Numerous prior art swabs use external rod-like members for actuating various valves and control mechanisms within the swab such as shown in U.S. Pat. Nos. 2,642,002; Re 23,698; 2,674,951; 2,821,142; 2,878,754; 2,937,598; 3,055,306; 3,273,504; 3,329,211; 3,424,093; 4,363,606; 4,531,891 and 4,984,969. However, none of these external rods or valves are used for opening and closing the open end of a flow through passage or bore within the valve as in the present invention.

U.S. Pat. No. 3,090,315 shows a piston having a control rod which appears to reduce the sliding friction with the internal surface of the bore forming wall by the use of radially extending pins or arms on the rod.

Another problem with existing swabs is that many of the swabs use flexible bell-shaped elastomeric seals such as shown in U.S. Pat. No. 4,528,896, to provide a generally fluid tight seal between the swab and inside surface of the well casing to permit the fluid pressure beneath the swab to raise the swab within the casing. However, occasionally a swab will bindup within the well casing, such as when the flexible seals are at a junction between casing sections or experiences irregularities on the internal surface of the casing. This will result in the pressure beneath the swab continuing to increase until it reaches a sufficiently great pressure to blow by the flexible seal, either by turning the seal upwardly on itself or blowing a hole through the seal, in order to escape to the area above the swab and equalize the pressure within the well casing. This then may require that the swab be retrieved or "fished out" from the bottom of the well, all of which results in increased well operating costs and reduced efficiency.

Accordingly, the need exists for an improved gas and oil well swab which provides a simple, effective and efficient operating valve for opening and closing the main fluid flow passage through the body of the swab, which reduces hangup of the operating control rod within the well body, and which prevents excess pressure from damaging the flexible swab seals within the well casing.

SUMMARY OF THE INVENTION

Objectives of the invention include providing an improved gas and oil well swab which uses an externally located control valve which positively opens and closes an end opening of a fluid flow through passage of the swab upon the valve contacting a stop member at the bottom of the well, and which is unaffected by the internal pressure within the well casing.

A still further objective is to provide such an oil well swab in which the control valve is connected to an actuating rod which has a cross-sectional configuration that provides a plurality of lines of sliding contact with the internal diameter of the bore forming walls to reduce friction, and most importantly to prevent binding up of the actuating rod within the bore.

Another objective of the invention is to provide such a swab in which a pressure relief valve prevents damage to the flexible elastomeric seals heretofore caused by excessive pressure build up beneath the seals, by providing an escape port for the excess pressure upon it reaching a dangerous level.

Still another objective of the invention is to provide such a swab in which sealing rings are provided between the flexible elastomeric seals and the valve body to increase the sealing effectiveness therebetween.

A further objective of the invention is to provide such a swab in which the actuating rod acts as its own guide and requires no internal guide rings or supports thereby lessening the possibility of the rod binding up within the fluid passage, in which sand and debris is free to fall out of the bottom opening of the fluid flow passage which extends axially through the center of the swab when the actuating valve is open; and in which the swab is free of radial flow passages and other circuitous passages which are susceptible to breakage or reduced flow through due to the accumulation of sand and other debris.

Another objective is to provide such a swab in which the externally located valve has a conical fluid dynamic shape which enables the swab to cut through the fluid as it descends through the casing preventing it from prematurely closing by reducing the pressure exerted on the valve end.

A further objective is to provide such a swab which is of a relatively simple, effective and durable construction, which is free of complicated moving mechanisms subject to breakage and maintenance due to the harsh environment in which the swab operates.

These objectives and advantages are obtained by the improved swab of the present invention, the general nature of which may be stated as including an elongated hollow body having a generally cylindrical inner surface defining a bore extending through said body and providing an internal fluid flow passage; top and bottom port means formed in the body and communicating with the internal flow passage, said lower port means being in general axial alignment with the bore; seal means mounted on the body to provide a seal between an outer surface of the swab and an interior wall of a well casing; an actuating rod slidably mounted within the cylindrical bore of the swab body; valve means connected to the actuating rod and movable between open and closed positions with respect to the bottom port means for permitting the flow of fluid into the bore from the well casing through the bottom port means when in the open position during the descent of the swab in said casing, and for blocking the flow of fluid into the bore when in the second position during ascent of the swab in the well casing; and the actuating rod having a cross-sectional configuration providing only line sliding contact with the inner surface of the bore of the body and having an area no greater than seventy five percent of the cross-sectional area of the bore.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

FIG. 5 is a sectional view taken on line 5—5, FIG. 3;

FIG. 6 is an enlarged sectional view taken on line 6—6, FIG. 2;

FIG. 7 is an enlarged sectional view taken on line 7—7, FIG. 2;

FIG. 8 is an enlarged fragmentary sectional view of the encircled portion of FIG. 2;

FIG. 9 is a cross-sectional view similar to FIG. 6, showing a modified actuating rod; and FIG. 10 is a sectional view similar to FIGS. 6 and 9, showing a further modified actuating rod configuration.

Similar numerals refer to similar parts throughout the drawings.

DESCRIPTION OF THE PREFERRED EMBODIMENTS

Figure 1:
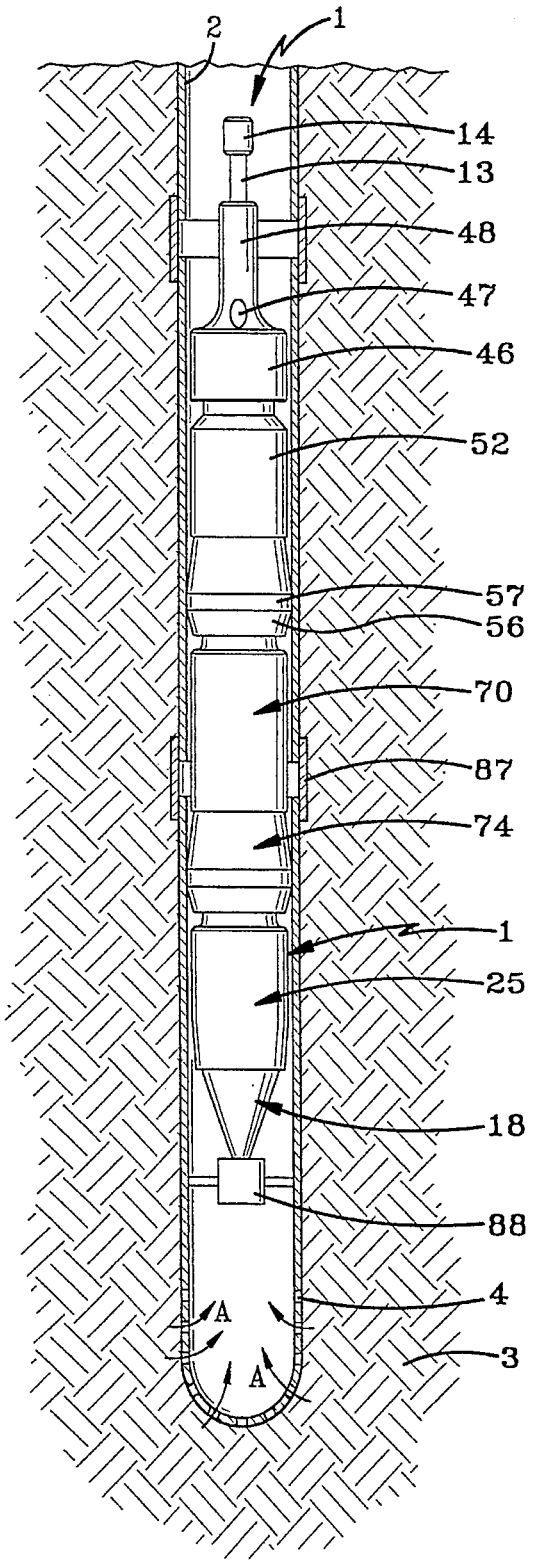
FIG. 1 is a diagrammatic fragmentary view, portions of which are in section, of a gas and oil well installation showing the swab of the present invention at the bottom of a well casing.

FIG. 1 shows in diagrammatic form a gas and oil well installation containing the improved swab of the present invention, which is indicated generally at 1. The swab is located within a well tubing or casing 2 hereinafter referred to as the casing, which extends downwardly to an oil and gas producing formation 3. The bottom of casing 2 is formed with a plurality of perforations 4 through which the oil and gas trapped within formation 3 will flow, as indicated by arrows A. Upon accumulation of sufficient pressure within casing 2 below swab 1, it will move swab 1 upwardly in casing 2 to a spot generally adjacent and preferably above the ground level (not shown) where the swab is caught in a catcher or other type of well known retaining mechanism, whereupon the oil trapped above swab 1 flows through the casing into other pipes mounted adjacent to or on top of casing 2, and into a sales line and/or collection tank. All of these mechanisms and equipments are readily known in the well art and therefore are not described in greater detail.

Well swab 1 is best shown in FIGS. 2–8 and includes an elongated hollow body 6 having a cylindrical inner surface 7 which defines a bore 8 that extends throughout the length of body 6. An elongated actuating rod 10 is slidably mounted within bore 8 of body 6, and in accordance with the invention has various cross-sectional shapes in order to provide a plurality of sliding line contacts with cylindrical inner surface 7, as described in further detail below. The first embodiment of rod 10 is best shown in FIG. 6 in which it has a rectangular cross-sectional configuration thereby providing four lines of sliding contact 12 with cylindrical surface 7, that is, at each corner of rod 10. Rod 10 preferably is formed of a rigid metal material, such as stainless steel.

Figure 2:
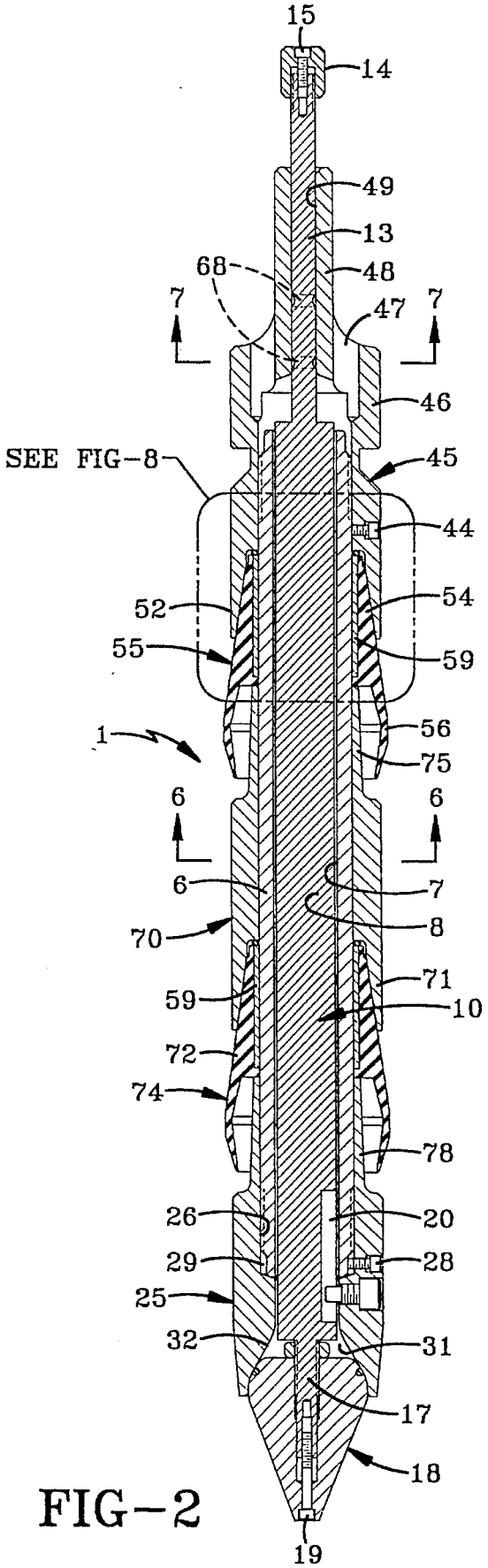
FIG. 2 is an enlarged longitudinal sectional view of the swab shown in FIG. 1.
Figure 3:
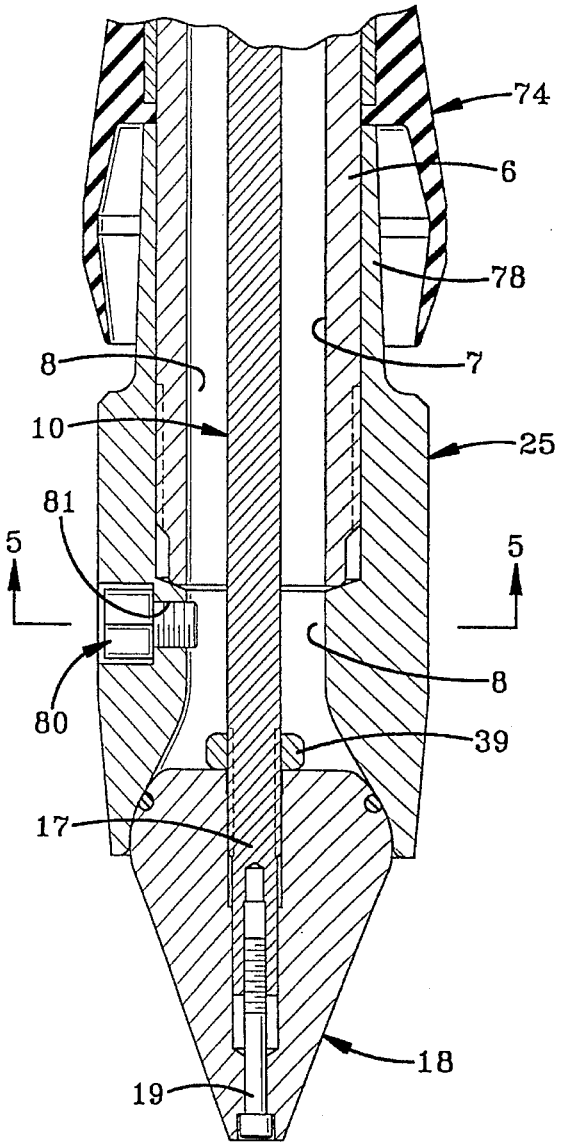
FIG. 3 is a further enlarged fragmentary section view of the bottom portion of the swab, with the control valve being shown in closed position.

The upper end of rod 10 has a reduced, preferably cylindrical end 13, and has a rod cap 14 mounted on its outer end by a rod cap bolt 15 (FIG. 2). The bottom end of actuating rod 10 is formed with an elongated reduced diameter tip 17 on which is mounted a control valve indicated generally at 18, by a bolt 19. Rod end 17 preferably is an extension of the smaller dimension of the rectangular cross section of rod 10 as shown in FIG. 3. An axially extending slot 20 is formed in the lower end of rod 10 and extends a predetermined axially length along the rod to limit the travel and prevent rotation of the rod within bore 8. A set screw 22 is threadably mounted within a threaded opening 23 formed in an annular sleeve indicated generally at 25, and extends into slot 20 to limit the travel of rod 10.

Figure 4:
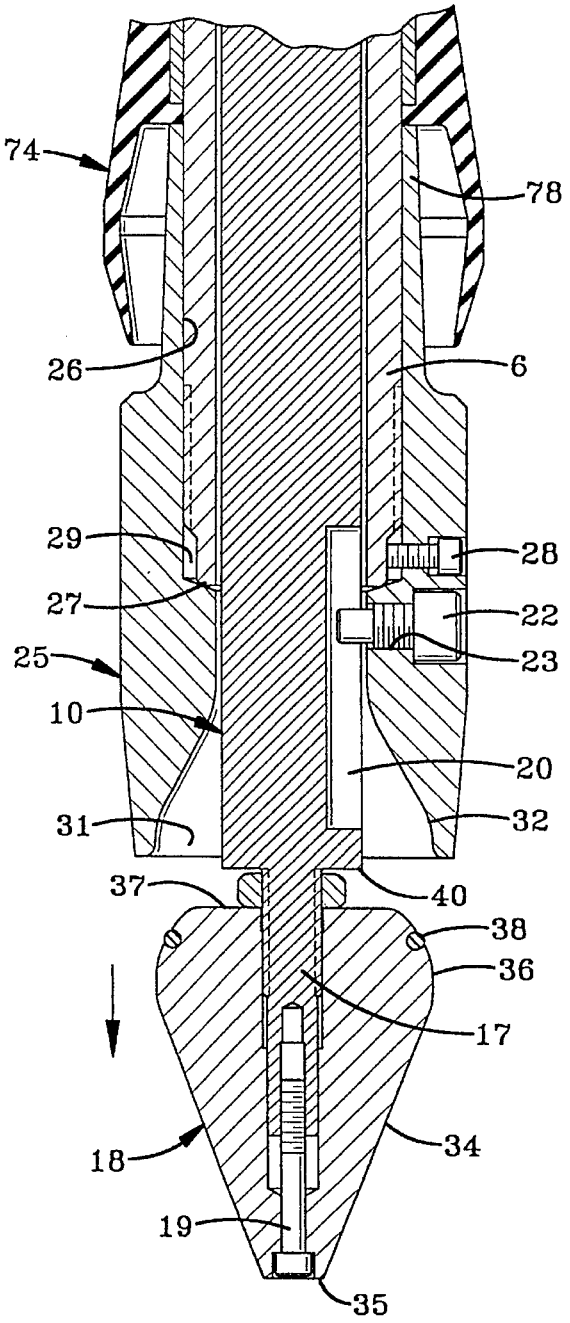
FIG. 4 is a sectional view similar to FIG. 3 with the valve being shown in open position.

Sleeve 25 has an elongated annular configuration formed with an irregularly shaped internal bore 26, the upper portion of which is telescopically slidably mounted on body 6, with the lower end of body 6 resting upon an annular shoulder 27 formed within the sleeve bore (FIG. 4). A set screw 28 extends through a threaded hole formed in sleeve 25 and into clamping engagement within an annular groove 29 formed in the bottom end of body 6 to secure sleeve 25 on body 6. Sleeve 25 has an open bottom end 31, defined by an annular outwardly flared wall 32 which defines a valve seat for valve 18 and the fluid inlet opening or passage into bore 8.

Valve 18 (FIGS. 3 and 4) has a generally conical shaped body formed by a conical wall 34 which terminates at its outer end in a blunt nose 35, through which attachment bolt 19 extends. The opposite end of valve 18 has a bulbous configuration 36 which terminates in a flat end wall 37. An O-ring 38 is mounted within a complementary shaped recess formed in bulbous end 36 to provide a seal when the valve is in the closed position with flared walls 32 of the valve seat as shown in FIG. 3. Another O-ring 39 is telescopically mounted on rod tip 17 and is clamped between flat end 37 of valve 18 and a bottom shoulder 40 of actuating rod 10.

As shown in FIG. 3, valve 18 completely seals off open bottom end 31 of sleeve 25 preventing the passage of any fluid through bore 8 of body 6. However, when valve 18 is in the open position of FIG. 4, it permits the passage of fluid through the open end of sleeve 25 and the open areas within bore 8 between the sides of actuating rod 10 and cylindrical inner surface 7 of body 6 as shown in FIG. 6. The shape of rod 10 provides a relatively large cross-sectional opening which extends throughout the axial length of body 6 for the passage of fluid, when valve 18 is in the open position of FIG. 4.

An end cap indicated generally at 45 (FIG. 2), is telescopically mounted on the upper end of body 6 and is secured thereto by a set screw 44 (FIG. 8). End cap 45 includes an upper annular base 46 which is formed with a plurality of circumferentially spaced circular holes 47 (FIG. 7) which communicate with bore 8 to provide fluid flow outlet passages which communicate with bore 8. An elongated cylindrical boss 48 is formed integrally with base 46 and extends upwardly therefrom, and is formed with a hollow bore 49 through which cylindrical top end 13 of rod 10 extends.

The lower end of end cap 45 (FIGS. 2 and 8) has a cylindrical configuration and is formed with a conical undercut 51 which forms a rigid annular skirt-like member 52 in which is received a complementary-shaped, hollow conical body 54 of an elastomeric seal, indicated generally at 55. Elastomeric seal 55 terminates in a flexible skirt 56 and provides seal 55 with an inverted bell-shaped configuration. Seal 55 preferably will have an annular cylindrical portion 57 (FIG. 1) which provides the main sealing contact with the inner surface of casing 2. The entrapment of conical body 54 of elastomeric seal 55 within undercut 51 by rigid skirt 52, helps secure seal 55 in position on body 6 and reduces damage to the seal.

Seal 55 (FIG. 8) is mounted on a cylindrical metal sleeve 59 which is telescopically mounted on body 6. In accordance with one of the features of the invention a sealing O-ring 60 is mounted at the top end of metal sleeve 59 and in abutment with an annular radial shoulder 61 at the end of undercut 51 in end cap 45. Ring 60 provides a generally fluid tight seal preventing fluid from entering between body 6 and end cap 45 even upon the continuous flexing movement of the seal as the swab moves upwardly and downwardly within casing 2.

A ball detent assembly 62 (FIGS. 2 and 7) is mounted in annular base 46 of end cap 45 and includes a ball valve 64, a biasing spring 65, and a retaining set screw 66. Ball 64 is alternately engageable in one of a pair of axially spaced, annular grooves 68, which are formed in top end 13 of actuating rod 10, for selectively retaining rod 10 and correspondingly valve 18, in the opened and closed positions. Thus, when valve 18 is in the closed position of FIGS. 2 and 3, ball detent assembly 62 will be engaged in the lower annular recess 68 for retaining valve 18 in this position. When valve 18 is in the open position of FIG. 4, ball detent assembly 62 will be engaged in the uppermost annular groove 68 to retain valve 18 in this open position until it is moved to the closed position as described more fully below.

A center cup support sleeve 70 is telescopically slidably mounted on the outer surface of body 6 (FIGS. 2 and 6) between end cap 45 and bottom sleeve 25. Sleeve 70 includes a lower annular rigid skirt 71, similar to skirt 52 of end cap 45, for telescopically receiving the conical body portion 72 of a second elastomeric seal, which is indicated generally at 74. The upper end 75 of sleeve 70 is abutted against an annular shoulder 77 of upper seal 55 to retain the seal in position on body 6 (FIG. 8). A similarly shaped upper end 78 is formed on sleeve 25 (FIGS. 2–4) and clamps lower seal 74 in position, partially recessed within center sleeve 70. Thus, sleeve 25 is clamped in position on the bottom end of body 6 by set screw 28, and end cap 45 is secured in position on the upper portion of body 6 by set screw 46, and together they clamp upper elastomeric seal 55 and lower seal 74 in position on body 6, with rod 10 being movable within bore 8 of body 6.

In accordance with another feature of the invention, a pressure relief valve 80 (FIGS. 3 and 5) is threadably mounted or press-fitted within a hole 81 formed radially through sleeve 25 to provide communication between the interior of the well casing and bore 8. Relief valve assembly 80 includes a valve 82 and a spring 83 which biases valve 82 to a closed position blocking the flow of fluid through a valve opening 84. A cylindrical washer 85 is mounted at the outer end of valve assembly 80 and functions as a piston which is acted upon by the internal fluid pressure within casing 2 for actuating the valve assembly.

Relief valve assembly 80 is located below the lower most elastomeric seal 74 and prevents damage to the seals which can occur by a large increase of fluid pressure within the well casing. Swab 1 operates generally in the same manner as other similar types of well swabs, that is, upon the accumulation of sufficient fluid pressure beneath swab 1 to overcome the weight of the swab and the pressure above, swab 1 will begin to rise within casing 2 moving the oil which has accumulated above the swab towards the surface. However, during the ascent of the swab within the casing, it can bind up, particularly when the flexible seals pass pipe section collars 87, stopping the ascent of the swab. However, the fluid pressure continues to accumulate beneath the swab and will "blow by" the elastomeric seals in order to equalize with the pressure above the swab, either forming holes in the seals or turning the flexible skirts back upon themselves, resulting in damage to the seals requiring subsequent placement and the possible need of retrieving the swab from the bottom of the well.

However, when the pressure beneath bottom seal 74 reaches an unsafe condition, it will apply pressure to piston washer 85 of relief valve assembly 80, sufficient to overcome the force of spring 83 and unseat valve 82 permitting the pressure to be relieved through fluid passage 84 and into bore 8 and out through top holes 47 equalizing the pressure. This will enable the swab to descend slightly in the well casing and hopefully free itself from the previous bound up condition, afterwhich spring 83 will reseat valve 82 sealing off the pressure relief passage 84.

The operation of improved swab 1 is best visualized in FIGS. 1–4. When descending or free falling in casing 2, valve 18 will be in the open position as shown in FIG. 4 whereby the fluid within the well casing beneath swab 1 will flow through the open bottom end 31 of the swab and upwardly through bore 8, and in particularly through the open spaces within bore 8 provided by the cross-sectional configuration of rod 10. Upon swab 1 reaching the bottom of casing 2, valve 18 will strike a stop member 88 (FIG. 1) with sufficient force to overcome the biasing affect of ball detent spring 65 enabling actuating rod 10 to move upwardly within body 6 moving valve 18 to the closed position of FIGS. 2 and 3. In this closed position, detent ball 64 will then be engaged in the uppermost annular groove 68 retaining rod 10 and valve 18 in the closed position. Thus, when in the closed position as indicated above, it will permit the accumulation of pressure beneath the valve enabling it to raise swab 1 upwardly within casing 2 carrying with it all of the oil which accumulated thereabove during its descent through casing 2, until it reaches the surface where it is caught in a usual manner until subsequently released for starting another pumping cycle. Also as indicated above, should the swab become bound up within casing 2, pressure relief valve 80 will actuate to prevent damage to elastomeric seals 55 and 74.

In accordance with one of the main features of the invention, the cross sectional shape of actuating rod 10 as shown in FIG. 6 provides for sliding line contact 12 with cylindrical inner surface 7 of bore 8 to reduce the sliding friction therebetween, and more particularly prevent the binding of rod 10 within body 6. Furthermore, the relatively large open areas between rod 10 and cylindrical inner surface 7 provides for the easy flow of the fluid through body 6 as swab 1 descends within well casing 2.

Slightly modified forms of actuation rod 10 are shown in FIGS. 9 and 10 wherein two different actuating rods indicated at 90 and 91 respectively, are shown mounted within body 6. These modified rods again provide only sliding line contact with cylindrical inner surface 7 of bore 8. As shown in FIG. 10, rod 91 has a triangular cross-sectional configuration and only three line contacts 92 are provided, reducing even further the sliding friction, while providing the large open areas within bore 8 surrounding rod 91 for the flow of fluid therethrough. Rod 90 has a generally X-shaped cross-sectional configuration and provides multiple sliding line contacts with wall surface 7. Due to the relatively harsh environment in which swab 1 operates, wherein sand and other grit easily find their way into bore 8, the large areas within bore 8 surrounding the actuating rod, prevents these particles from becoming lodged between the rod and the inner bore surface since the particles can flow easily upwardly through bore 8 or drop out of end opening 31 when valve 18 is in the open position.

It has been found that to achieve satisfactory results, the cross-sectional area of the actuating rod is no greater than 75% than the cross-sectional area of bore 8. Likewise, due to the sliding engagement of the rod with interior surface 7 of body 6, the rod acts as its own guide and requires no internal guide rings which are subject to breakage and maintenance as in many prior art swab constructions.

The external mounting of control valve 18 eliminates complicated internal controls as in prior art valves, which are also subject to breakage and maintenance due to the harsh environment in which they operate. Also the conical shape of valve 18 enables the swab to cut through the fluid as it moves downwardly in the casing preventing the valve from prematurely closing, since it provides a fluid dynamic effect cutting through the fluid. Furthermore, no internal or external control means are required to actuate the control valve since it is actuated automatically upon striking a stop member at the bottom of the casing and does not rely upon internal pressure for closing the valve as in many prior art swab constructions. Valve mounting bolt 19 enables actuating rod 10 to be adjusted with respect to the valve to ensure proper alignment of ball detent assembly 62 at the upper end thereof, with retaining grooves 68. Furthermore, other than the incorporation of the pressure relief valve assembly 80 and its corresponding fluid relief passage 84, there are no other flow passages into bore 8 except through open bottom end 31, which as can be seen in FIG. 4, provides a relatively large opening for the flow of fluids into bore 8 as the swab descends within casing 2.

Accordingly, the improved gas and oil well swab is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved gas and oil well swab is constructed and used, the characteristics of the construction, and the advantageous, new and useful results obtained; the new and useful structures, devices, elements, arrangements, parts and combinations, are set forth in the appended claims.

We claim:

1. A swab for mounting within a well casing including:

a) an elongated hollow body having a generally inner surface defining an axial bore extending through said body and providing an internal fluid flow passage;

b) openings formed in upper and lower portions of the body and communicating with the internal flow passage;

c) seal means mounted on the body to provide a seal between an outer surface of the swab and an interior wall of a well casing;

d) an actuating rod slidably mounted within the bore of the swab body;

e) valve means connected to the actuating rod for opening and closing the opening formed in the lower portion of the body for regulating the flow of fluid through the bore from a well casing during the descent and ascent of the swab in said casing; and f) pressure relief means mounted in the swab body between the seal means and the valve means providing a relief passage extending between an interior of a well casing and the fluid flow passage within the body for automatically opening upon the fluid pressure within a well casing reaching a predetermined amount.

2. The swab defined in claim 1 in which the actuating rod has a triangular cross-sectional configuration.

3. The swab defined in claim 1 in which the actuating rod has a rectangular cross-sectional configuration.

4. The swab defined in claim 1 in which the actuating rod has an X-shape cross-sectional configuration.

5. The swab defined in claim 1 in which the valve means includes a generally downwardly tapered valve member located externally of the swab body and movable automatically from the open to the closed position upon said valve member striking a stop in a lower portion of a well casing.

6. The swab defined in claim 5 in which the bottom port means is formed by an outwardly flared open bottom end which forms a valve seat; and in which the valve means has a substantially conical-shaped body which converges into an outer end.

7. The swab defined in claim 6 in which an O-ring is mounted between the conical-shaped body of the valve means and the valve seat to form a generally fluid tight seal therebetween when the valve means is in the closed position.

8. The swab defined in claim 1 including detent locking means mounted on the swab body for operatively engaging the rod to selectively retain the valve means in the open and closed positions.

9. The swab defined in claim 1 in which slot means is formed the actuating rod; and in which fastening means is mounted in the valve body and extends into the actuating rod slot for preventing rotation of said rod within the bore of said body.

10. The swab defined in claim 1 in which the seal means includes at least one elastomeric hollow tubular body and an inverted substantially bell-shaped flexible skirt forming an inverted cup-shaped member; in which a rigid sleeve is telescopically mounted on the tubular body and includes a rigid skirt which extends partially along the elastomeric tubular body for mounting the seal means on said body; and in which a resilient O-ring is mounted between the rigid sleeve and elastomeric tubular body of the seal means to provide a generally fluid tight seal therebetween.

11. The swab defined in claim 1 in which the swab includes an end cap mounted on an upper end of said body; in which said end cap has an annular base and an axially extending hollow boss; in which the actuating rod extends through a hollow bore formed in said boss; and in which a plurality of holes are formed in the end cap and extend in a circular fashion about said boss, said holes forming the top port means of said swab.

12. The swab defined in claim 1 in which the pressure relief means is mounted within a passage formed in the swab body and includes a valve and a spring biasing said valve toward a closed position, whereby the fluid pressure within a well casing overcomes the biasing force of the spring to open said relief valve upon reaching a predetermined pressure.

13. The swab defined in claim 10 in which the passage is orthogonal to the axis of the fluid flow passage.

14. The swab defined in claim 1 in which the axial bore has a cylindrical inner surface; in which the actuating rod has a cross-sectional configuration providing only line sliding contacts with said inner surface of the bore, and has a cross-sectional area no greater than seventy five percent of the cross-sectional area of the bore.

15. A swab for mounting within a well casing including:

a) an elongated hollow body having a generally cylindrical inner surface defining a bore extending through said body and providing an internal fluid flow passage;

b) top and bottom port means formed in the body which communicate with the internal flow passage, said lower port means being in general axial alignment with the bore;

c) seal means mounted on the body to provide a seal between an outer surface of the swab and an interior wall of a well casing;

d) an actuating rod slidably mounted within the cylindrical bore of the swab body;

e) valve means connected to the actuating rod and movable between open and closed positions with respect to the bottom port means for permitting the flow of fluid into the bore from the well casing through said lower port means when in the open position during the descent of the swab in said casing, and for blocking the flow of fluid into the bore when in the second position during ascent of the swab int he well casing;

f) stop means mounted on the body and engageable with the actuating rod for preventing rotation of said rod within the bore of said body and for limiting the sliding movement of said rod beyond said open and closed positions; and g) pressure-actuated relief means positioned between the seal means and the valve means for forming a relief passage extending between the interior of a well casing and the fluid flow passage within the body for automatically opening upon the fluid pressure within a well casing reaching a predetermined amount, said relief means being mounted on the body and includes a valve and a spring biasing said valve toward a closed position, whereby fluid pressure within a well casing automatically opens said valve when said pressure becomes greater than the biasing force of said spring.

16. The swab defined in claim 15 in which the relief valve and spring are mounted in a passage formed in the swab body orthogonal to the axis of the fluid flow passage.

17. The swab defined in claim 15 in which the stop means includes a slot formed in the actuating rod, and a fastening mounted in the valve body and extending into said actuating rod slot.

* * * * *